US010479085B2

(12) United States Patent
Mourey et al.

(10) Patent No.: US 10,479,085 B2
(45) Date of Patent: Nov. 19, 2019

(54) PRINTHEAD ELECTRICAL INTERCONNECTS

(71) Applicant: Hewlett-Packard Development Company, L.P., Houston, TX (US)

(72) Inventors: Devin Alexander Mourey, Albany, OR (US); Chien-Hua Chen, Corvallis, OR (US); Michael W. Cumbie, Albany, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/749,399

(22) PCT Filed: Oct. 21, 2015

(86) PCT No.: PCT/US2015/056596
§ 371 (c)(1),
(2) Date: Jan. 31, 2018

(87) PCT Pub. No.: WO2017/069748
PCT Pub. Date: Apr. 27, 2017

(65) Prior Publication Data
US 2018/0222202 A1 Aug. 9, 2018

(51) Int. Cl.
*B41J 2/16* (2006.01)
*B41J 2/175* (2006.01)

(52) U.S. Cl.
CPC ..... *B41J 2/1637* (2013.01); *B41J 2/1603* (2013.01); *B41J 2/164* (2013.01); *B41J 2/1626* (2013.01);
(Continued)

(58) Field of Classification Search
CPC . B41J 2/14024; B41J 2/155; B41J 2/16; B41J 2/1603; B41J 2/1626; B41J 2/1637;
(Continued)

(56) References Cited

U.S. PATENT DOCUMENTS 5,946,012 A * 8/1999 Courian ..... B41J 2/04511 347/63
6,394,580 B1 5/2002 Scheffelin et al.
(Continued)

FOREIGN PATENT DOCUMENTS

| | | |
|---|---|---|
| EP | 1432581 | 6/2004 |
| WO | WO-2014133633 | 9/2014 |
| WO | WO-2015080730 | 4/2015 |

OTHER PUBLICATIONS

Donald J. Hayes et al., "Low-Cost Display Assembly and Interconnect Using Ink-Jet Printing Technology," (Research Paper), http://microfab.com/images/papers/displayworks-99.pdf, May 1999, 4 pages.

*Primary Examiner* — Anh T Vo
(74) *Attorney, Agent, or Firm* — HP Inc. Patent Department

(57) ABSTRACT

In one example, a method for fabricating a printhead is described. The method may include applying an electrical interconnect between a printhead die and an electrical fan out structure embedded in a molding of a printhead via a direct patterning additive process. The method may further include applying a passivation layer over the electrical interconnect as a dry film laminate.

20 Claims, 8 Drawing Sheets

(52) U.S. Cl.
CPC ..... *B41J 2/17503* (2013.01); *B41J 2202/22* (2013.01)

(58) Field of Classification Search
CPC ..... B41J 2/164; B41J 2/175; B41J 2/17503; B41J 2202/22; H01L 24/43; H01L 24/85
See application file for complete search history.

(56) References Cited

U.S. PATENT DOCUMENTS

| | | | | |
|---|---|---|---|---|
| 6,641,254 | B1 * | 11/2003 | Boucher | B41J 2/14072 257/E23.133 |
| 7,887,635 | B2 * | 2/2011 | Kim | B01L 3/0268 118/720 |
| 8,815,626 | B2 | 8/2014 | Golda et al. | |
| 2002/0051036 | A1 | 5/2002 | Scheffelin et al. | |
| 2009/0153616 | A1 | 6/2009 | Anderson et al. | |
| 2009/0289356 | A1 * | 11/2009 | Camacho | H01L 21/6835 257/737 |
| 2010/0188449 | A1 | 7/2010 | Kim et al. | |
| 2011/0025782 | A1 | 2/2011 | Haluzak et al. | |
| 2013/0223034 | A1 | 8/2013 | Rathburn | |
| 2015/0145141 | A1 | 5/2015 | Uzoh et al. | |

* cited by examiner

PRINTHEAD ELECTRICAL INTERCONNECTS

CROSS-REFERENCE TO RELATED APPLICATION

Pursuant to 35 U.S.C. § 371, this application is a United States National Stage Application of International Patent Application No. PCT/US2015/056596, filed on Oct. 21, 2015, the contents of which are incorporated by reference as if set forth in their entirety herein.

BACKGROUND

In a printing device, a printhead, such as in an inkjet pen or print bar, may include a number of dies containing nozzles for delivering printing fluid to a printing medium. For example, each die may include channels that carry printing fluid to ejection chambers for each of the nozzles. Each die may also include electronic components, such as gated logic and other micro-electro-mechanical structures (MEMS) for controlling the delivery of the printing fluid to the printing medium. For example, a resistive heating element or a piezoelectric ejection element may be used to heat the printing fluid in an ejection chamber to force a droplet of printing fluid out of the nozzle. Accordingly, each die may be electrically connected to other components of the printhead, such as an application specific integrated circuit (ASIC), a surface mounted device (SMD), and so forth, or to other components of the printing device.

DETAILED DESCRIPTION

Figure 1:
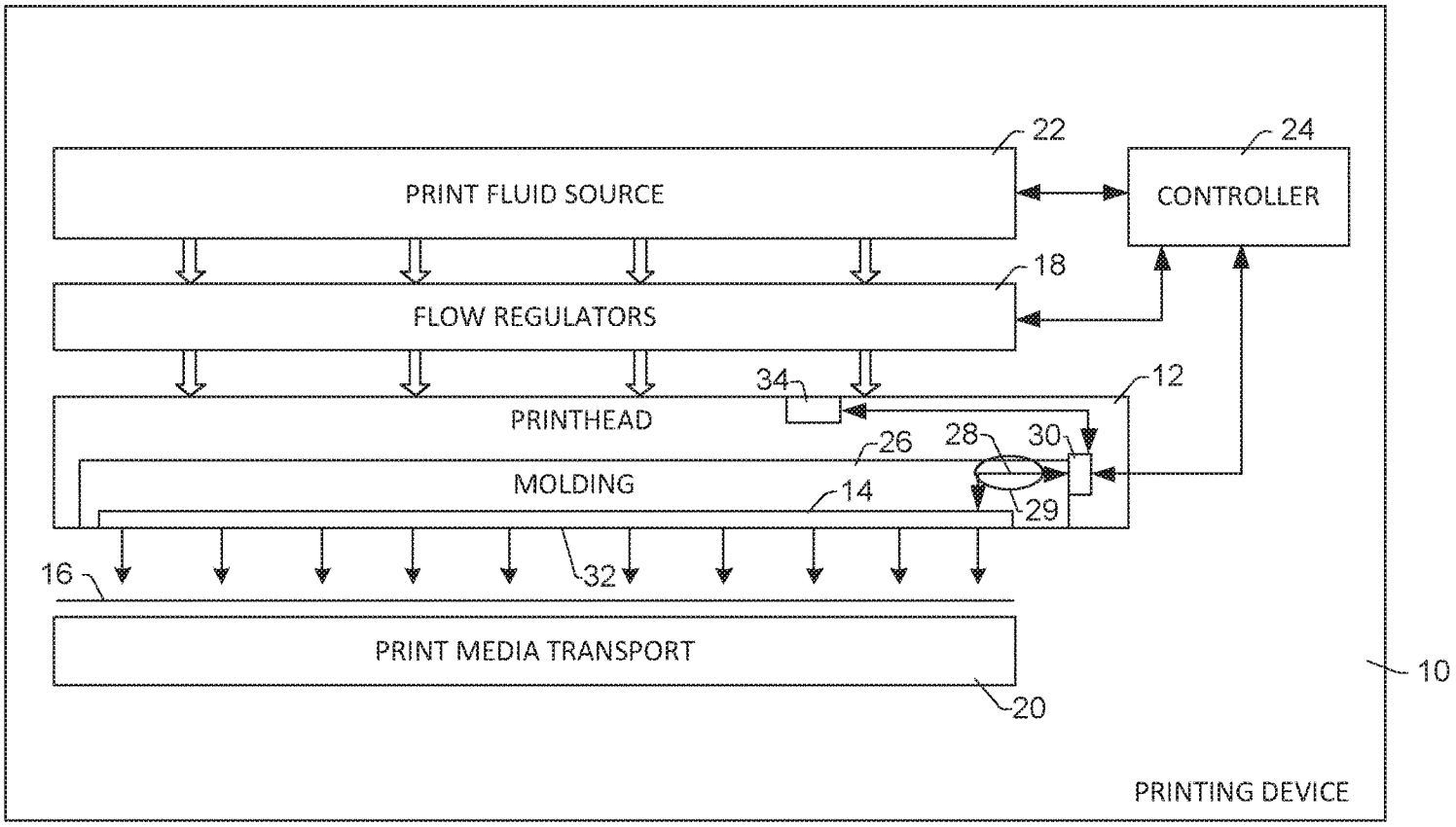
FIG. 1 illustrates a block diagram of an example printing device.

In one example, the present disclosure describes a method for fabricating a printhead. For example, the method may include applying an electrical interconnect between a printhead die and an electrical fan out structure embedded in a molding of a printhead via a direct patterning additive process. The method may further include applying a passivation layer over the electrical interconnect as a dry film laminate.

In another example, the present disclosure describes a device that may include a printhead die, a printed circuit assembly, and a molding, where the printhead die and the printed circuit assembly are embedded in a surface of the molding. The device may further have an interconnect structure that includes an electrical interconnect over an electrical contact of the printhead die, an electrical contact of the printed circuit assembly, and a portion of the surface of the molding between the printhead die and the printed circuit assembly, and a passivation layer over the electrical interconnect. In one example, a thickness of the interconnect structure may be less than 100 microns.

In still another example, the present disclosure describes a method for fabricating a printhead. For example, the method may include applying a conductive layer between a printhead die and a printed circuit assembly embedded in a molding of a printhead via a shadow mask process to form an electrical interconnect, and applying a dielectric layer over the electrical interconnect as a dry film laminate.

Examples of the present disclosure relate to printheads that may be referred to as "molded printheads." In one example, the present disclosure relates to printheads for thermal inkjet printing. As used herein, the terms "printhead" and "printhead die" refer to the parts of a printing device that can dispense fluid from one or more openings. A molded printhead may comprise one or more printhead dies, where each die may include printhead nozzles for dispensing a printing fluid, such as dye-based ink, pigment-based ink, liquid toner, ultraviolet (UV)-curable ink, and so forth, as well as microelectromechanical structures (MEMSs), and other electronic circuits, such as metal-oxide-semiconductor (MOS) logic. The one or more dies may be embedded in a molding, such as an epoxy mold compound (EMC), a plastic, or other substrate. An electrical fan out structure, such as a printed circuit assembly (PCA), including a printed circuit board (PCB), a flex circuit, a lead frame, and so forth, all of which may be referred to herein as a "board," may also be embedded in the molding and electrically connected to the die. For example, an electrical fan out structure may be used to enable a smaller sized die to support a larger number of input-output pins than would be able to fit on the die itself.

The present disclosure describes methods or processes to fabricate electrical interconnects on a molded printhead, e.g., the electrical interconnects between a printhead die and a board. One example of the present disclosure features an electrical interconnect comprising a direct-patterned, thin film conductive layer over the molding between the die and the board, passivated with a dielectric layer. The dielectric layer may electrically isolate and protect the conductive layer from any printing fluids or other materials that may contact the surface of the printhead. In one example, the conductive layer is directly-patterned via an additive process, in contrast to subtractive based approaches, such as those involving plating and photoresist. In addition, examples of the present disclosure also focus patterning around the electrical interconnect structure, while not exposing the rest of the die to the processes. For instance, in screen printing electrodes between the die and the board, the rest of the die regions, such as near the nozzles, are exposed to the chemistry and other processes associated with the electrode screen printing. Thus, materials for forming the interconnect structure that may be deposited in the nozzle region may need to be removed via further operations, e.g., subtractive processes, such as etching. However, such operations may be difficult and time consuming to complete, and may not be fully effective. In contrast, in examples of the present disclosure, materials for forming the electrical interconnect structure are not deposited in a nozzle region of the printhead die. In one example, the present disclosure creates an interconnect structure with a low profile, e.g., less than 100 microns of height, inclusive of the conductive layer and the passivation layer. A thinner electrical interconnect structure may make the printhead easier to service. It may also reduce the size of the die and the cost of the printhead. In one example of the present disclosure, the height of the electrical interconnect and passivation layer may be reduced to 20-50 microns or less.

In one previous approach, a wire bond is used between the die and a pad, and from the pad to the board. However, it may be difficult to reduce the height, or thickness of the interconnect structures below 150 microns using this technique. Another approach is to form a thin conductive layer for an electrical interconnect using plating or other photolithography based processes. However, the nozzles on the die may be exposed to chemistry, such as plating chemistry, or the photoresist that is used in metal patterning. The nozzles on the die may also be exposed to other materials during deposition processes, such as sputtering or evaporation. Thus, the materials may need to be removed from the die to re-expose the nozzles. Still another previous approach comprises using through silicon vias (TSVs) in the die, wire bonding the die to the board through the back-end, and then embedding the wire bonds in the mold compound. However, TSVs may weaken the dies and are more costly to implement.

In one example of the present disclosure, a shadow mask approach is used where a conductive layer, e.g., one or more electrical interconnects, is deposited locally between the die and the board. In another example, a jet dispensing of the conductive layer is used. Using either approach, e.g., a shadow mask or jet dispensing, the material for the conductive layer, e.g., a metal, is deposited at or near the ends of the die such that the nozzles are not exposed to the material. In addition, where a shadow mask is used, there is no stripping involved in removing the shadow mask, once application of the material for the conductive layer is complete.

As mentioned above, a passivation layer, e.g., a dielectric layer, may be patterned on top of the conductive layer to act as an electrical isolator between printing fluid that may linger on the surface of the printhead and the underlying electrical interconnects. In one example, by applying a passivation layer using dry film lamination, the nozzles are not filled with resist or passivation layer material, e.g., as when applied wet, which would then need to be stripped from the nozzles and ejection chambers. In addition, it may be impractical to use a dry film laminate in connection with wire bond based electrical interconnects for example, since it may result in crushing of the wire bonds. In contrast, in the present disclosure, when a thin film electrical interconnect is deposited, it is possible to apply the passivation layer in the form of a dry film, localized dielectric layer over those regions. In one example, the fabrication of the passivation layer may include stamping, where a pattern is created in the passivation layer and then transferred to the printhead assembly. In another example, the passivation layer may be applied as a dry film laminate and then features photo-defined or patterned in the passivation layer using a stencil or mask. For example, the dry film laminate may tend to "tent" over surface features, such as nozzles of the printhead die, rather than fill the nozzles and the ejection chambers. Therefore, the dielectric material may be removed from such locations via a photo-patterning after it is laid.

In one example, the material used for the passivation layer over the conductive layer of the electrical interconnect can be the same material that is used for the nozzle and/or ejection chamber layer, or layers. In this way, there may be fewer unique material interfaces in the surface of the printhead. In one example, the material may comprise a negative photoimageable epoxy, e.g., a photoimageable siloxane or similar silicon based material, resist, or dielectric film. For instance, the material may comprise a UV-sensitive negative photo-resist comprising epoxy resin, gamma butyrolactone, and triaryl sulfonium salt, or a similar commercially available material. In one example, such materials may be applied as the passivation layer in a dry film (laminate) format. However, in another example, such materials may be applied as the passivation layer via a needle/jet-dispensing. For instance, a jet-dispensed dielectric material may be deposited as a gel, which may then be cured by photo-exposure, e.g., to ultraviolet (UV) light. In addition, the application via jet-dispensing may be localized over the conductive layer, e.g., the electrical interconnects, such that the nozzles of the printhead are not affected, even when use of a mask or stencil is omitted.

These and other aspects of the present disclosure are described in greater detail below in connection with the example FIGS. 1-13.

FIG. 1 is a block diagram illustrating an example printing device 10. In various examples, printing device 10 may comprise such devices as: a personal printer, an ink-jet printer, a laser-jet printer, a digital press or digital printing press, an offset printing press, a printer-copier, a printer-scanner, a printer-copier-scanner, a printer-copier-fax, and so forth. As illustrated in FIG. 1, printing device 10 may include a printhead 12, e.g., a print bar, spanning the width of a print medium 16, flow regulators 18 associated with printhead 12, a print media transport 20, printing fluid sources(s) 22, and a controller 24. In one example, controller 24 may comprise processor(s) and memory(ies) storing programs, code and/or instructions, which when executed by the processor(s), cause the processor(s) to control various operative components of printing device 10. In one example, printhead 12 includes an arrangement of one or more printhead dies 14 for dispensing printing fluid on to a sheet or continuous web of paper or other print media, e.g., print medium 16 via nozzles of the one or more printhead dies 14 facing surface 32. As also illustrated in FIG. 1, the one or more printhead dies 14 may be embedded in a molding 26 of the printhead 12. Electrical interconnects 28 between printhead die(s) 14 and the contacts 30 to external circuits are provided, e.g., to enable control of and communications with electronic or micro-electromechanical structures (MEMS) of the printhead die(s) 14 by the controller 24 or by other electronic components 34, such as an application specific integrated circuit (ASIC) or a surface mounted device (SMD). In one example, the electrical interconnects 28 are formed using a direct-patterning process, such as a process that includes the use of a shadow mask and/or jet deposition. In addition, in one example, the electrical interconnects are electrically isolated from the printing fluid that may aggregate on surface 32 using a passivation layer 29, such as a dry film laminate. In one example, the combined height of the electrical interconnects 28 and passivation layer 29 formed in this way is reduced to below 100 microns, e.g., 20-50 microns or less.

Figure 2:
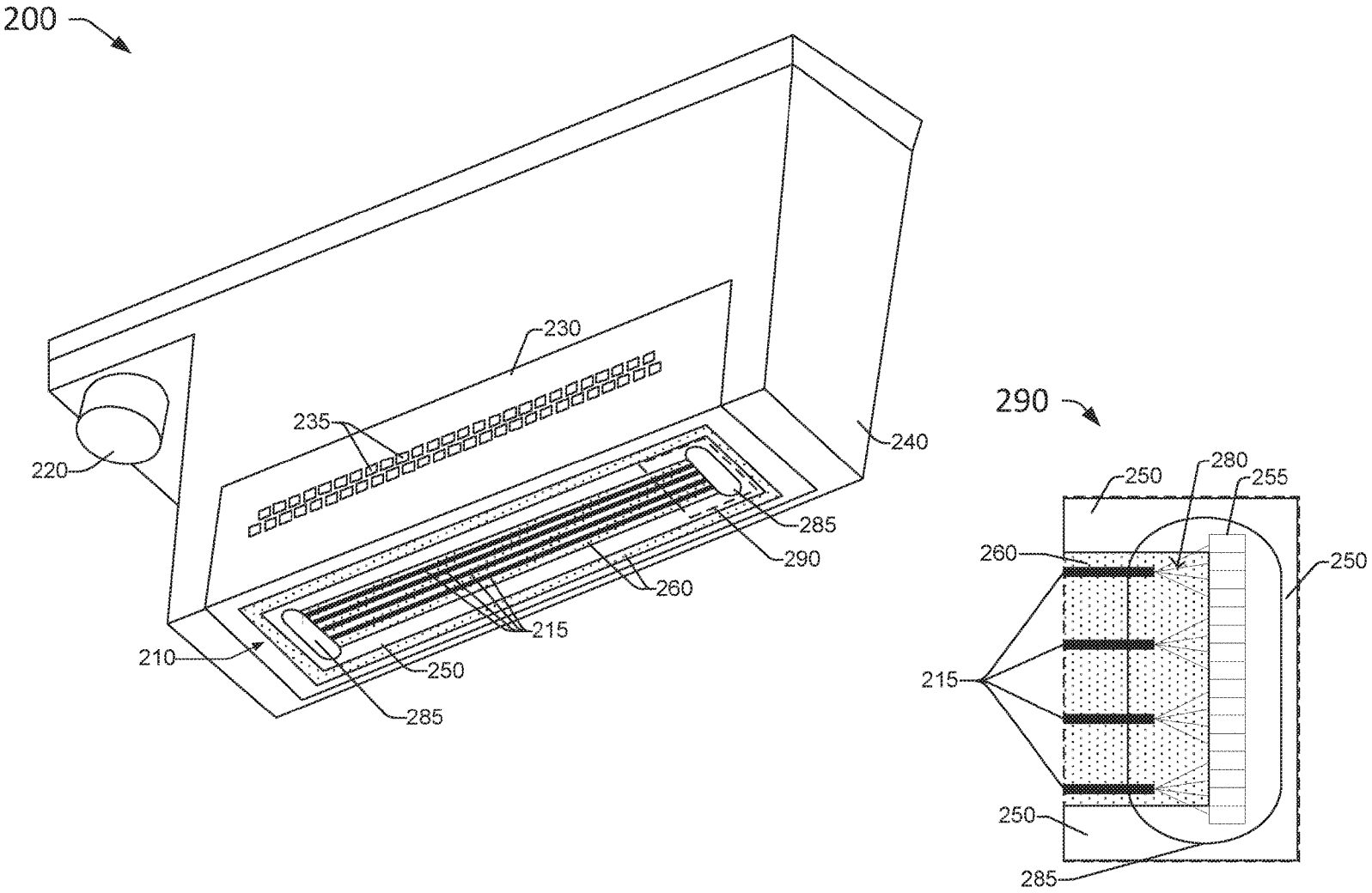
FIG. 2 illustrates an example cartridge for a printing device.

FIG. 2 illustrates an example cartridge 200 for a printing device. Cartridge 200 includes a printhead 210 with four printhead dies 215 embedded in a molding 260 that is supported by a cartridge housing 240. While a single printhead 210 with four dies 215 is shown for cartridge 200, other configurations are possible, for example with more printheads 210 each with more or fewer dies 215. As illustrated in FIG. 2, cartridge 200 also includes a port 220 for the ingress of printing fluid, and electrical contacts 235 for connecting to external components, such as a printing device controller. As also illustrated in the example of FIG. 2, contacts 235 are formed in a flex circuit 230 affixed to the housing 240. Tiny wires (not shown) may be embedded in the flex circuit 230, often referred to as traces or signal traces, to connect contacts 235 to corresponding contacts 255 on printhead 210. In one example, contacts 255 are part of one or more printed circuit assemblies 250. In one example, nozzles on the printhead dies 215 are for ejecting printing fluid to a printing medium. In addition, in one example the printhead dies 215 are electrically coupled to the contacts 255 by electrical interconnects 280, which may be fabricated using a direct-patterning process, such as a process that includes the use of a shadow mask and/or jet deposition. The electrical interconnects 280, as well as the contacts 255 may also be covered by a passivation layer 285. For example, passivation layer 285 may comprise a dry film laminate applied over the electrical interconnects 280 and over contacts 255. Inset box 290 illustrates a region of the printhead 210 including printhead dies 215, contacts 255, electrical interconnects 280, and passivation layer 285 in greater detail. For illustrative purposes, passivation layer 285 is shown transparently to reveal the printhead dies 215, contacts 255, and electrical interconnects 280, as well as portions of the molding 260 and printed circuit assembly 250.

Figure 3:
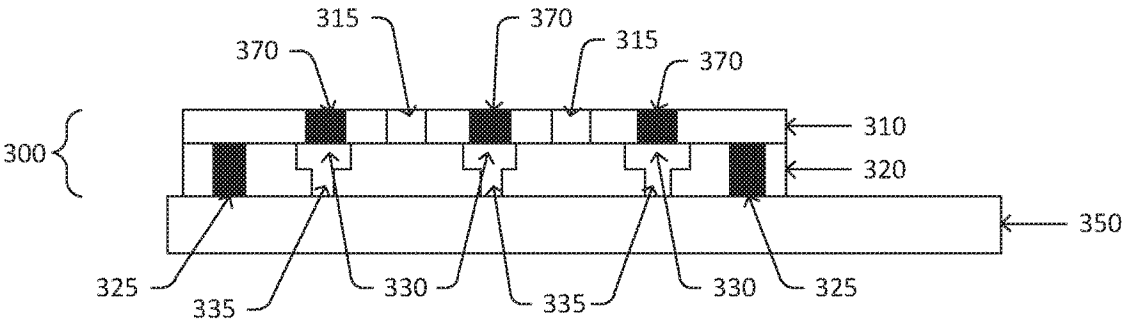
FIG. 3 illustrates an example printhead die during a printhead fabrication process.

FIGS. 3-9 illustrate various stages of a fabrication of a printhead assembly. For example, FIG. 3 illustrates an example printhead die 300 during a printhead fabrication process. In one example, the printhead die 300 includes layer(s) 320 forming nozzles 335 and ejection chambers 330. Electrical contact pads 325 are embedded in layer(s) 320 and are connected to layer(s) 310, which may contain electronic or MEMS devices, such as ejector elements 370. Layer(s) 310 may also include features 315, such as manifolds and/or ports for delivering printing fluid to the ejection chambers 330 and nozzles 335. It should be noted that the printhead die 300 may include multiple electrical contact pads 325, and the layer(s) 310, layer(s) 320, ejector elements 370, ejection chambers 330, and nozzles 335 and may comprise various configurations that differ from the example illustrated in FIG. 3. As shown in FIG. 3, the printhead die 300 is placed nozzle side down on a support medium 350, e.g., a thermal release tape, which may comprise a double sided tape.

Figure 4:
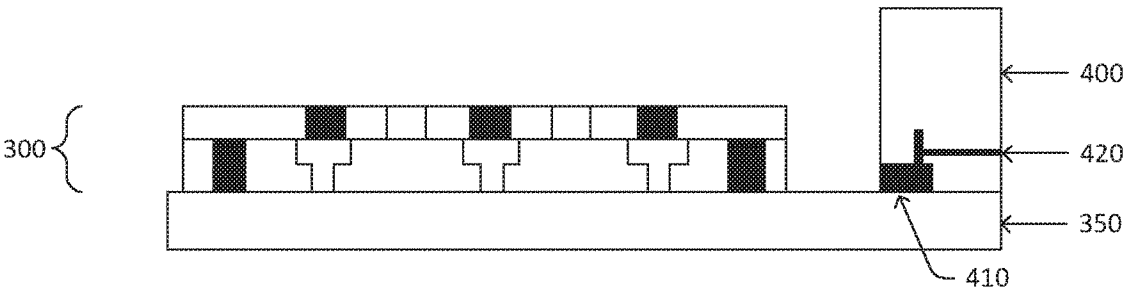
FIG. 4 illustrates an example printhead die and a board, e.g., a printed circuit assembly (PCA), during a printhead fabrication process.

FIG. 4 illustrates an example printhead die 300 and a board 400, e.g., an electrical fan out structure, during a printhead fabrication process. For instance, FIG. 4 may represent a stage of a printhead fabrication process after that which is illustrated in FIG. 3. As shown in FIG. 4, the board 400 is placed onto the support medium 350. The board 400 may include an electrical contact pad 410 and conductive traces 420. It should be noted that the board 400 may include multiple contact pads 410, and the conductive traces 420 may comprise various configurations that differ from the simplified version illustrated in FIG. 4. In addition, labels for various components of the die 300 that are shown in FIG. 3 are omitted from FIG. 4 for clarity.

Figure 5:
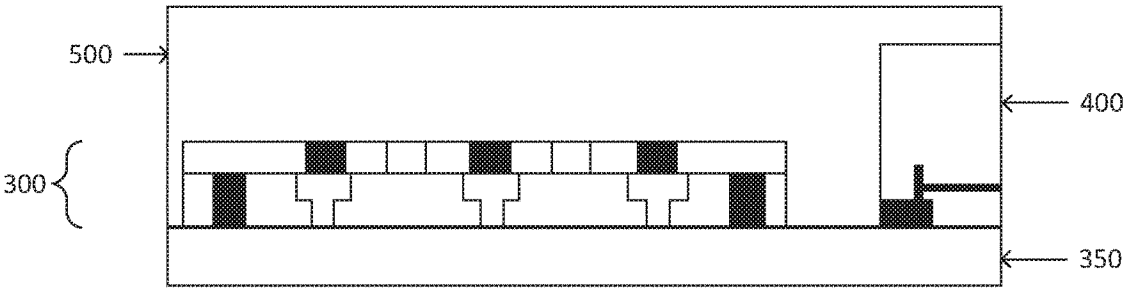
FIG. 5 illustrates an example printhead during a printhead fabrication process, including a printhead die, a board, and a molding.

FIG. 5 illustrates an example printhead during a printhead fabrication process, including a printhead die 300, a board 400, and a molding 500, e.g., an epoxy mold compound (EMC). For instance, FIG. 5 may represent a stage of a printhead fabrication process after that which is illustrated in FIG. 4. The die 300 and board 400 are affixed to a support medium 350. The molding 500 may be applied to surround the die 300 and board 400 such that the die 300 and the board 400 are embedded in the molding 500. For instance, a compression mold may be used to define the shape of the molding 500. The die 300, board 400 and the support medium 350 may be placed in the mold. The material for the molding 500 may then be dispensed into the mold chase cavity, cured, and the mold released. In addition, labels for various components of the die 300 and board 400 that are shown in FIGS. 3 and 4 are omitted from FIG. 5 for clarity.

Figure 6:
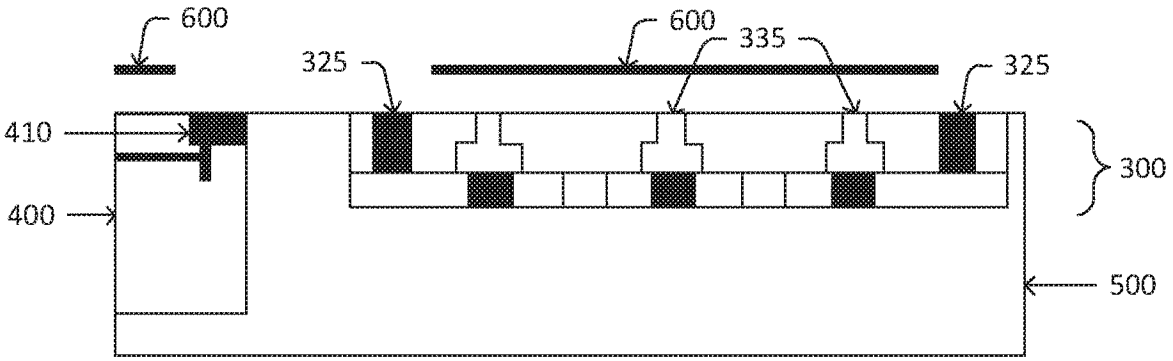
FIG. 6 illustrates an example printhead during a printhead fabrication process, including a printhead die, a board, a molding, and a shadow mask.

FIG. 6 illustrates an example printhead during a printhead fabrication process, including a printhead die 300, a board 400, a molding 500, and a shadow mask 600. For instance, FIG. 6 may represent a stage of a printhead fabrication process after that which is illustrated in FIG. 5. As illustrated in FIG. 6, the support medium 350 has been removed. In one example, the printhead is also flipped over such that the side of the die 300 containing nozzles 335 faces upward. As also illustrated in FIG. 6, a shadow mask 600 is placed over the die 300 and over portions of board 400. However, the shadow mask 600 may include openings in areas that include electrical contact pads 325, contact pad 410, and a portion of the molding 500 between the die 300 and board 400. In one example the shadow mask 600 may comprise a patterned and/or a micro-machined metal template comprising nickel, nickel-brass, beryllium-copper, stainless steel, and so forth. In addition, labels for various components of the die 300 and board 400 that are shown in FIGS. 3 and 4 are omitted from FIG. 6 for clarity.

Figure 7:
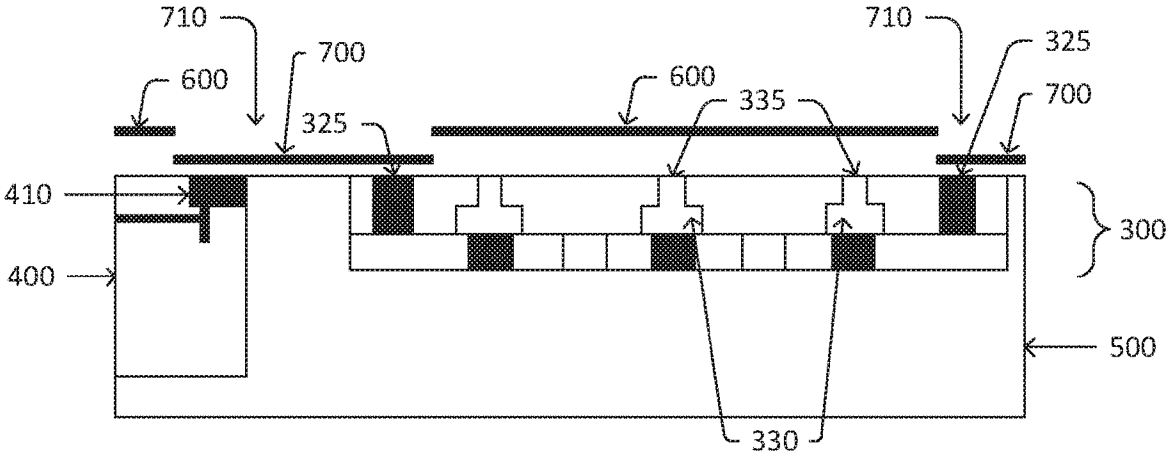
FIG. 7 illustrates an example printhead during a printhead fabrication process, including a printhead die, a board, a molding, a shadow mask, and electrical interconnects.

FIG. 7 illustrates an example printhead during a printhead fabrication process, including a printhead die 300, a board 400, a molding 500, a shadow mask 600, and electrical interconnects 700. For instance, FIG. 7 may represent a stage of a printhead fabrication process after that which is illustrated in FIG. 6. In one example, the electrical interconnects 700 comprise a layer of conductive material, e.g., a metal, such as aluminum, copper, indium, titanium, gold, silver, alloys of such metals, and the like, that is deposited in the direction indicated by arrows 710. In one example, the conductive material is applied via sputtering. In another example, the conductive material is applied via an evaporation. For instance, the conductive material may be evaporated using an electron beam, and deposited in regions of the printhead that are exposed through openings in the shadow mask. In one example, the evaporated conductive material may be focused on a particular region of the printhead based upon an orientation of an opening of a crucible where the source conductive material is contained. However, due to the presence of shadow mask 600, the area of die 300 containing nozzles 335 may avoid exposure to the conductive material as it is applied. In another example, FIG. 7 may represent the deposition of a conductive material to form electrical interconnects 700 via a jet dispensing. In such case, the shadow mask 600 may be omitted, or may still be utilized as additional protection for preventing the conductive material from infiltrating nozzles 335. For instance, the application via jet dispensing may be localized to the region of the printhead between electrical contact pads 325 and 410 such that the nozzles of the printhead are not affected, even when use of a shadow mask is omitted. In addition, labels for various components of the die 300 and board 400 that are shown in FIGS. 3 and 4 are omitted from FIG. 7 for clarity.

Figure 8:
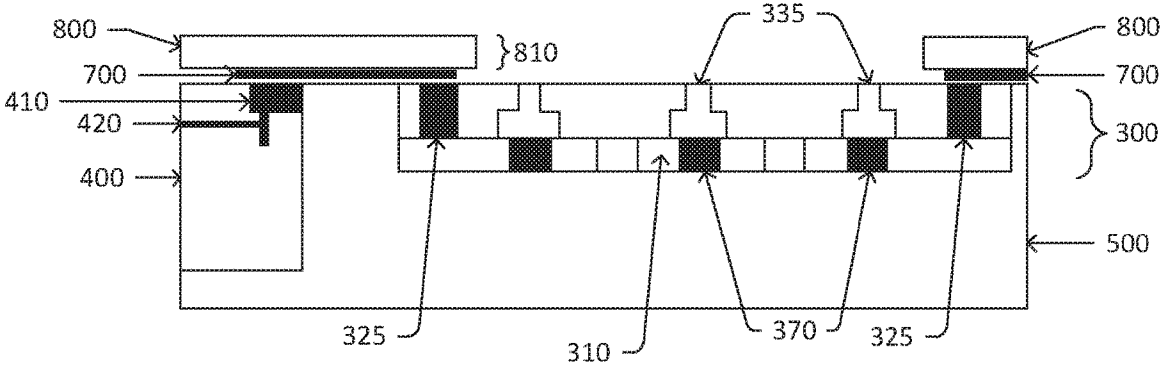
FIG. 8 illustrates an example printhead during a printhead fabrication process, including a printhead die, a board, a molding, electrical interconnects, and a passivation layer.

FIG. 8 illustrates an example printhead during a printhead fabrication process, including a printhead die 300, a board 400, a molding 500, electrical interconnects 700, and a passivation layer 800. For instance, FIG. 8 may represent a stage of a printhead fabrication process after that which is illustrated in FIG. 7. In one example, passivation layer 800 may be applied as a dry film laminate. For instance, passivation layer 800 may comprise a negative photoimageable epoxy, e.g., a photoimageable siloxane or similar silicone based material, resist, or dielectric film. For instance, the material may comprise a UV-sensitive negative photo-resist comprising epoxy resin, gamma butyrolactone, and triaryl sulfonium salt, or a similar commercially available material. In one example, passivation layer 800 may be pre-fabricated with dimensions suitable for covering the electrical interconnects 700 and the regions of die 300 and board 400 near the electrical contact pads 325 and 410. For instance, the passivation layer 800 may be patterned via a stamping technique prior to application to the printhead. In another example, the passivation layer 800 may be patterned, or photo-defined after application to the printhead. By applying passivation layer 800 as a dry film laminate, exposure of the nozzles 335 or ejection chambers 330 to chemicals, or other materials or processes may be avoided. However, in another example, such materials may be applied as the passivation layer 800 via a needle/jet-dispensing. For instance, a jet-dispensed dielectric material may be deposited as a gel, which may then be cured by photo-exposure, e.g., to ultraviolet (UV) light. In addition, the application via jet-dispensing may be localized over the conductive layer, e.g., the electrical interconnects 700, such that the nozzles of the printhead are not affected, even when use of a mask or stencil is omitted.

In one example, the passivation layer 800 comprises a dielectric layer that electrically isolates and protects the electrical interconnects 700, e.g., a conductive layer, from any printing fluids or other materials that may contact the surface of the printhead. As illustrated in FIG. 8, the traces 420 of board 400 are electrically connected by a conductive path to electrical or MEMS components of die 300, such as ejector elements 370 in layer(s) 310, via electrical contact pad 410, electrical interconnects 700, and one or more contact pads 325. In one example, a thickness 810 of the interconnect structure, e.g., the passivation layer 800 plus the conductive layer comprising electrical interconnects 700, may be less than 100 microns.

Figure 9:
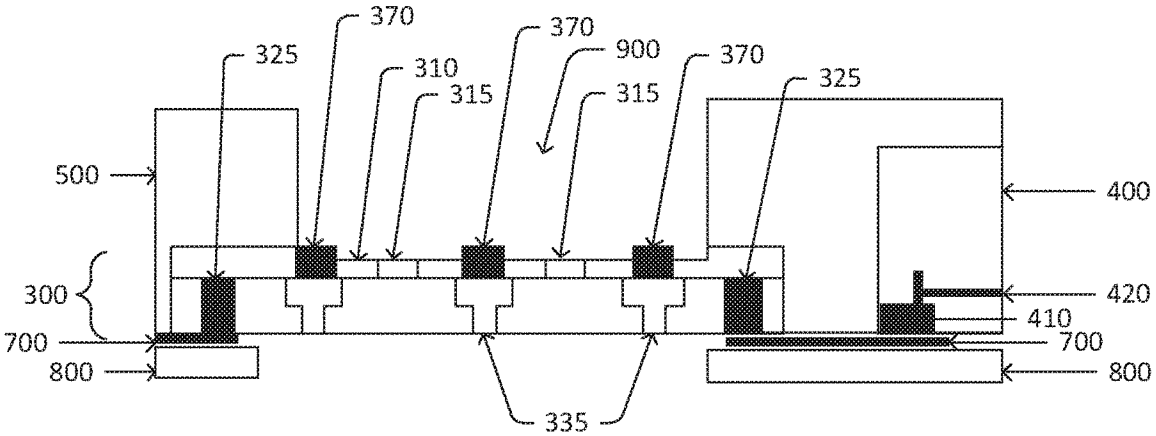
FIG. 9 illustrates an example printhead during a printhead fabrication process, including a printhead die, a board, a molding, electrical interconnects, a passivation layer, and a fluid channel.

FIG. 9 illustrates an example printhead during a printhead fabrication process, including a printhead die 300, a board 400, a molding 500, electrical interconnects 700, a passivation layer 800, and a fluid channel 900, For instance, FIG. 9 may represent a stage of a printhead fabrication process after that which is illustrated in FIG. 8. As shown in FIG. 9, the traces 420 of board 400 are electrically connected by a conductive path to electrical or MEMS components of die 300, such as ejector elements 370 in layer(s) 310, via electrical contact pad 410, electrical interconnects 700, and one or more contact pads 325. In one example, the fluid channel 900 may be created by sawing, powder blasting, etching, or another technique. The fluid channel 900 may connect a printing fluid source to features 315, such as manifolds and/or ports for delivering printing fluid to the ejection chambers 330 and nozzles 335. Although a rectangular cross-sectional shape of fluid channel 900 is illustrated, in various other examples various additional shapes may be used, such as shapes defined by curved sidewalls, a tapered or trapezoidal shape, and so forth.

Figure 10:
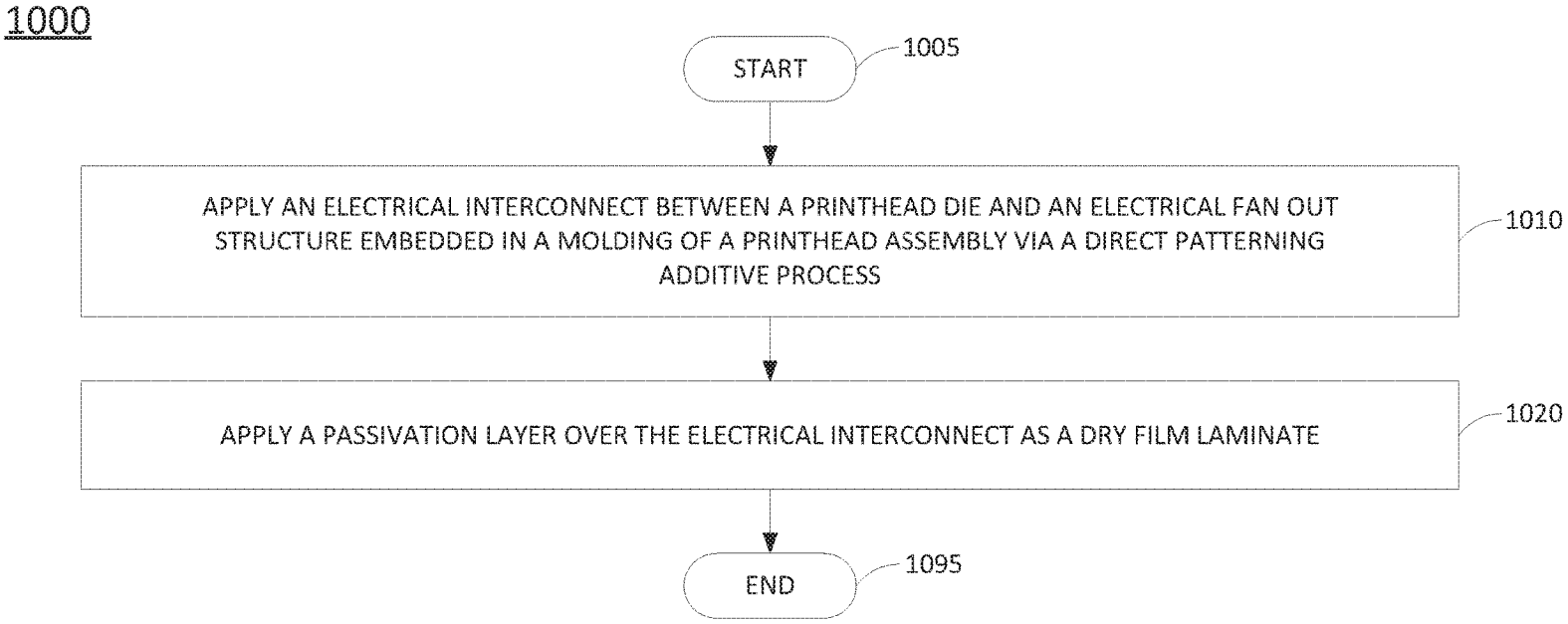
FIG. 10 is a flowchart of an example method for fabricating a printhead.

FIG. 10 illustrates a flowchart of an example method 1000 for fabricating a printhead. Blocks of the method 1000 may relate to one or more of the FIGS. 3-9, discussed above. However, the method 1000 is not limited to the particular configurations shown in such figures, which are provided for illustrative purposes.

The method 1000 begins in block 1005. In block 1010, an electrical interconnect is applied between a printhead die and an electrical fan out structure embedded in a molding. For instance, the printhead die, electrical fan out structure, and the molding in which the printhead die and electrical fan out structure are embedded may comprise a printhead for a printing device. In one example, the electrical fan out structure may comprise a printed circuit assembly, a flex circuit, or a lead frame. In one example, the molding may comprise an epoxy mold compound. In one example, the electrical interconnect may be formed by a direct patterning additive process. For example, the electrical interconnect may comprise a thin film of conductive material that is deposited via a shadow mask process and/or via a jet dispensing process. In one example, the shadow mask process may comprise the placing of a shadow mask over the printhead followed by deposition of the conductive material by an evaporation, e.g., electron beam evaporation, or a sputtering of the conductive material. In another example, the shadow mask process may comprise a screen printing, where a shadow mask is used as a stencil and the conductive material is applied as a silver or nano-carbon tube containing isotropic conductive paste, for instance. In one example, the shadow mask covers a portion of the printhead die that contains at least one printhead nozzle. In one example, the shadow mask may also cover at least a portion of the electrical fan out structure, e.g., a portion containing an electrical contact pad. However, the shadow mask may include one or more openings to define a region for forming the electrical interconnect(s) of the interconnect structure. Thus, the application of the electrical interconnects at block 1010 may comprise depositing the conductive material over a portion of the printhead defined by the one or more openings in the shadow mask. For instance, the portion of the printhead may comprise: a contact pad of the printhead die, a portion of the molding, and a contact pad of the electrical fan out structure. In one example, the operations of block 1010 may involve application of an electrical interconnect, as illustrated in FIG. 7 and as described above.

In block 1020, a passivation layer is applied over the electrical interconnect as a dry film laminate. In one example, the passivation layer may comprise a dielectric material, e.g., a negative photo resist, such as a photoimageable epoxy, to electrically isolate and protect the electrical interconnects/conductive layer from any printing fluids or other materials that may contact the surface of the printhead. For instance, in one example, the negative photo resist may comprise an epoxy resin, a gamma butyrolacetone, and a triaryl sulfonium salt. In one example, the passivation layer may comprise a material that is used for at least a portion of the printhead die, e.g., one or more layers forming nozzles and ejection chambers of the printhead die. In one example, block 1020 may involve application of a passivation layer as illustrated in FIG. 8 and as described above. Following block 1020, the method 1000 proceeds to block 1095 where the method ends.

Figure 11:
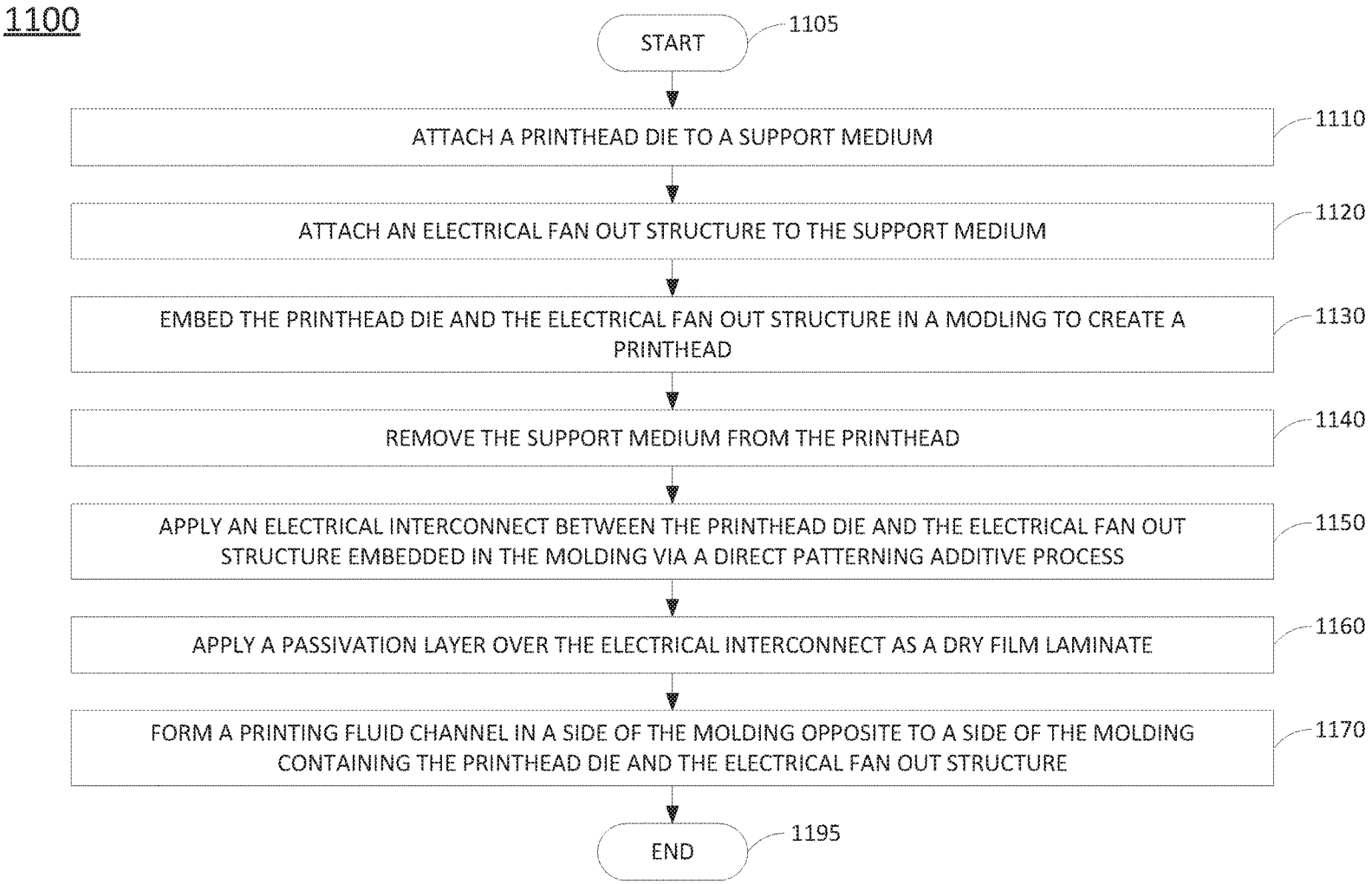
FIG. 11 is a flowchart of an additional example method for fabricating a printhead.

FIG. 11 illustrates a flowchart of an additional example method 1100 for fabricating a printhead. Blocks of the method 1100 may relate to one or more of the FIGS. 3-9, discussed above. However, the method 1100 is not limited to the particular configurations shown in such figures, which are provided for illustrative purposes.

The method 1100 begins in block 1105. In block 1110, a printhead die is attached to a support medium. In one example, the support medium may comprise a thermal release tape, which may also comprise a double sided tape. In one example, the operations of block 1110 may involve attaching a printhead die to a support medium as illustrated in FIG. 3 and as described above.

In block 1120, an electrical fan out structure is attached to the support medium. In one example, the operations of block 1120 may involve attaching an electrical fan out structure, e.g., a board, to a support medium as illustrated in FIG. 4 and as described above.

In block 1130, the printhead die and the electrical fan out structure are embedded in a molding to create a printhead. In one example, the operations of block 1130 may involve embedding a printhead die an electrical fan out structure in a molding as illustrated in FIG. 5 and as described above.

In block 1140, the support media is removed from the printhead. In one example, the operations of block 1140 may involve removal of a support medium from a printhead as illustrated in FIGS. 5-6 and as described above.

In block 1150, an electrical interconnect is applied between the printhead die and the electrical fan out structure embedded in the molding. In one example, the operations of block 1150 may comprise the same or similar operations to those described above in connection with block 1010 of FIG. 10. In one example, the operations of block 1150 may also involve application of an electrical interconnect, as illustrated in FIG. 7 and described above.

In block 1160, a passivation layer is applied over the electrical interconnect as a dry film laminate. In one example, the operations of block 1160 may comprise the same or similar operations to those described above in connection with block 1020 of FIG. 10. In one example, block 1020 may also involve application of a passivation layer as illustrated in FIG. 8 and as described above.

In block 1170, a printing fluid channel is formed in a side of the molding opposite to a side of the molding containing the printhead die and the electrical fan out structure. In one example, the operations of block 1170 may involve forming a printing fluid channel, e.g., via one of sawing, blasting, or etching, as illustrated in FIG. 9 and as described above. Following block 1170, the method 1100 proceeds to block 1195 where the method ends.

Figure 12:
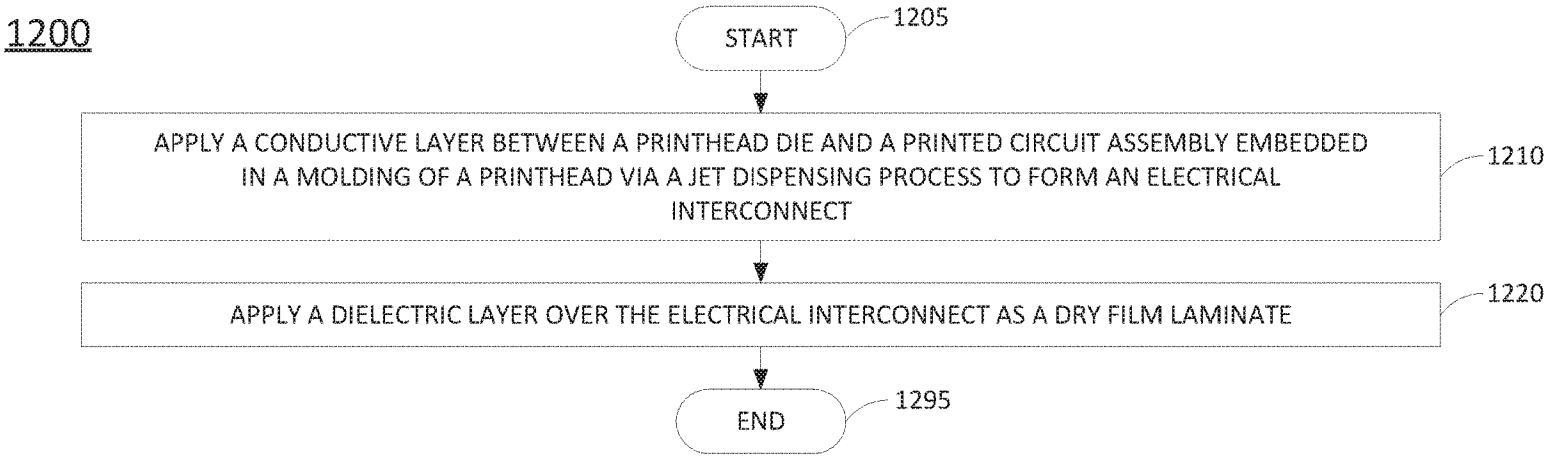
FIG. 12 is a flowchart of another example method for fabricating a printhead.

FIG. 12 illustrates a flowchart of another example method 1200 for fabricating a printhead. Blocks of the method 1200 may relate to one or more of the FIGS. 3-9, discussed above. However, the method 1200 is not limited to the particular configurations shown in such figures, which are provided for illustrative purposes.

The method 1200 begins in block 1205. In block 1210, a conductive layer is applied between a printhead die and a printed circuit assembly embedded in a molding of a printhead via a jet dispensing process to form an electrical interconnect. In one example, the jet dispensing process may be localized to a region of the printhead between electrical contact pads of the printhead die and the printed circuit assembly such that the nozzles of the printhead are not affected, even when use of a shadow mask is omitted. However, in one example, a shadow mask may also be used in conjunction with the jet dispensing process for further protection of the printhead nozzles. In one example, the operations of block 1210 may comprise application of a conductive layer, e.g., an electrical interconnect, via jet dispensing, as illustrated in FIG. 7 and as described above.

In block 1220, a dielectric layer, e.g., a passivation layer, is applied over the electrical interconnect as a dry film laminate. In one example, the operations of block 1220 may comprise the same or similar operations to those described above in connection with blocks 1020 and 1160 of the example methods 1000 and 1100 of FIGS. 10 and 11, respectively. Following block 1220, the method 1200 proceeds to block 1295 where the method ends.

Figure 13:
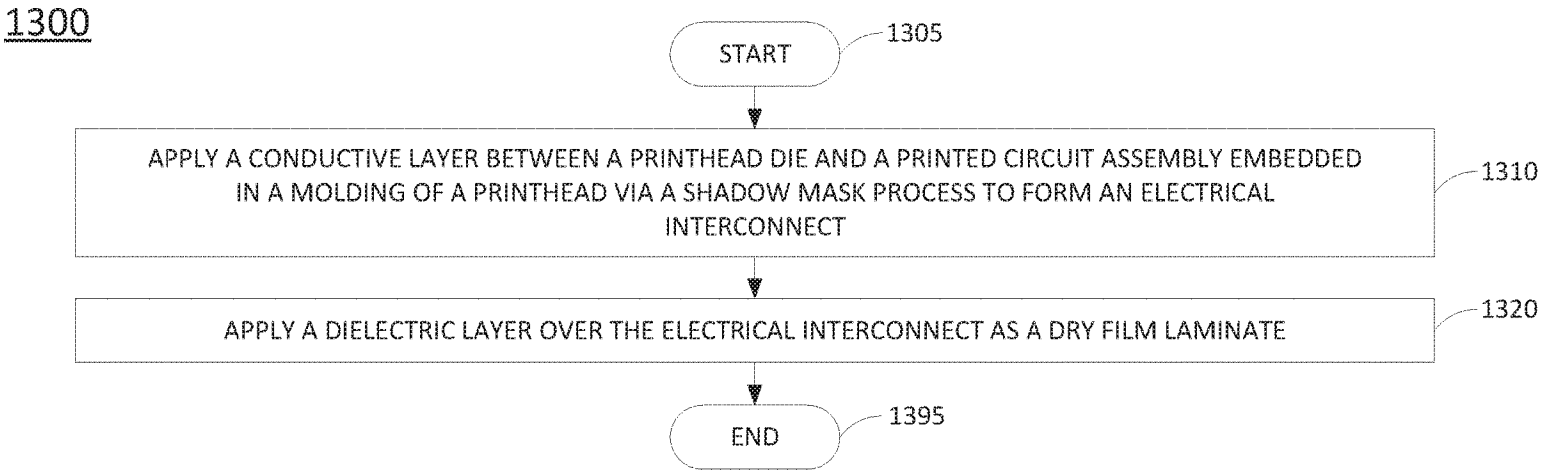
FIG. 13 is a flowchart of a further example method for fabricating a printhead.

FIG. 13 illustrates a flowchart of a further example method 1300 for fabricating a printhead. Blocks of the method 1300 may relate to one or more of the FIGS. 3-9, discussed above. However, the method 1300 is not limited to the particular configurations shown in such figures, which are provided for illustrative purposes.

The method 1300 begins in block 1305. In block 1310, a conductive layer is applied between a printhead die and a printed circuit assembly embedded in a molding of a printhead via a shadow mask process to form an electrical interconnect. In one example, the shadow mask process may include placing a shadow mask over the printhead to cover a nozzle portion of the printhead die and at least a portion of the printed circuit assembly. The shadow mask process may further include applying the conductive material via an evaporation or a sputtering to form the electrical interconnect in a region of the printhead defined by an open portion of the shadow mask. In one example, the operations of block 1310 may comprise application of a conductive layer via a shadow mask process, as illustrated in FIGS. 6-7 and as described above.

In block 1320, a dielectric layer, e.g., a passivation layer, is applied over the electrical interconnect as a dry film laminate. In one example, the operations of block 1320 may comprise the same or similar operations to those described above in connection with blocks 1020, 1160, and/or 1220 of the example methods 1000, 1100, and 1200 of FIGS. 10, 11, and 12, respectively. Following block 1320, the method 1300 proceeds to block 1395 where the method ends.

It should be noted that various blocks of the respective methods 1000, 1100, 1200, and 1300 may be considered optional in various examples. For instance, in one example, method 1100 may omit one or more of blocks 1110, 1120, 1130, 1140 or 1170. In addition, it should be noted that the respective methods 1000, 1100, 1200, and 1300 may also be expanded to include additional or alternative operations and functions, as described above in connection with various examples.

It will be appreciated that variants of the above-disclosed and other features and functions, or alternatives thereof, may be combined into many other different systems or applications. Various presently unforeseen or unanticipated alternatives, modifications, or variations therein may be subsequently made, which are also intended to be encompassed by the following claims.

What is claimed is:

1. A method comprising:

applying an electrical interconnect between a printhead die and an electrical fan out structure embedded in a molding of a printhead via a direct patterning additive process; and applying a passivation layer over the electrical interconnect as a dry film laminate.

2. The method of claim 1, wherein the direct patterning additive process comprises:

placing a shadow mask over the printhead; and applying a conductive material via one of an evaporation, a sputtering, or a screen printing to form the electrical interconnect in a region of the printhead defined by the shadow mask.

3. The method of claim 2, wherein the shadow mask is to cover a portion of the printhead die containing a printhead nozzle and at least a portion of the electrical fan out structure.

4. The method of claim 1, wherein the direct patterning additive process comprises:

a jet dispensing of a conductive material to form the electrical interconnect.

5. The method of claim 1, wherein the applying the electrical interconnect comprises depositing a conductive material over a surface of the printhead, the surface comprising: a contact pad of the printhead die, a portion of the molding, and a contact pad of the electrical fan out structure.

6. The method of claim 1, wherein the electrical fan out structure comprises one of:

a printed circuit assembly;

a flex circuit; or a lead frame.

7. The method of claim 1, wherein the molding comprises an epoxy mold compound.

8. The method of claim 1, wherein the passivation layer comprises a negative photo-resist.

9. The method of claim 8, wherein the negative photo-resist comprises:

an epoxy resin;

a gamma butyrolactone; and a triaryl sulfonium salt.

10. The method of claim 1, further comprising:

attaching the printhead die to a support medium;

attaching the electrical fan out structure to the support medium;

embedding the printhead die and the electrical fan out structure in the molding to create the printhead; and removing the support medium from the printhead.

11. The method of claim 1, further comprising:

forming a printing fluid channel in a side of the molding opposite to a side of the molding containing the printhead die and the electrical fan out structure.

12. A device comprising:

a printhead die;

a printed circuit assembly;

a molding, wherein the printhead die and the printed circuit assembly are embedded in a surface of the molding; and an interconnect structure comprising:

an electrical interconnect over an electrical contact of the printhead die, an electrical contact of the printed circuit assembly, and a portion of the surface of the molding between the printhead die and the printed circuit assembly; and a passivation layer over the electrical interconnect, wherein a thickness of the interconnect structure is less than 100 microns.

13. The device of claim 12, wherein materials for forming the electrical interconnect structure are not deposited in a nozzle region of the printhead die.

14. The device of claim 12, wherein the printed circuit assembly is embedded in the surface of the molding via a direct patterning additive process.

15. The device of claim 12, wherein the molding comprises an epoxy mold compound.

16. The device of claim 12, wherein the passivation layer comprises a negative photo-resist.

17. The device of claim 16, wherein the negative photo-resist comprises:

an epoxy resin;

a gamma butyrolactone; and a triaryl sulfonium salt.

18. The device of claim 12, further comprising:

a printing fluid channel in a side of the molding opposite to a side of the molding containing the printhead die and the printed circuit assembly.

19. A method, comprising:

applying a conductive layer between a printhead die and a printed circuit assembly embedded in a molding of a printhead via a shadow mask process to form an electrical interconnect; and applying a dielectric layer over the electrical interconnect as a dry film laminate.

20. The method of claim 19, wherein the shadow mask process comprises:

placing a shadow mask over the printhead to cover a nozzle portion of the printhead die and at least a portion of the printed circuit assembly; and applying the conductive material via an evaporation or a sputtering to form the electrical interconnect in a region of the printhead defined by an open portion of the shadow mask.

* * * * *